United States Patent [19]

King

[11] Patent Number: 4,977,636

[45] Date of Patent: Dec. 18, 1990

[54] PILE SUPPORTED BRIDGE ASSEMBLY

[76] Inventor: John B. King, 130 Kramer Ave., Winston-Salem, N.C. 27113

[21] Appl. No.: 400,362

[22] Filed: Aug. 30, 1989

[51] Int. Cl.[5] ..... E01D 19/00; E04B 1/16

[52] U.S. Cl. ..... 14/73; 14/75; 52/251; 52/259

[58] Field of Search ..... 14/1, 17, 73, 75; 52/251, 259, 127.2, 583, 585, 698, 723, 296, 299; 249/90, 19

[56] References Cited

U.S. PATENT DOCUMENTS

| | | | |
|---|---|---|---|
| Re. 23,074 | 1/1949 | Henderson | 52/263 |
| 1,205,465 | 11/1916 | Maguire et al. | 52/252 |
| 2,602,321 | 7/1952 | Blair | 14/75 |
| 3,794,433 | 2/1974 | Schupack | 14/73 |
| 3,821,869 | 7/1974 | Morgan | 52/259 |
| 3,842,552 | 10/1974 | Hudson | 14/73 |
| 3,906,687 | 9/1975 | Schupack | 52/259 |
| 4,051,570 | 10/1977 | Hilfiker | 14/75 |
| 4,107,889 | 8/1978 | Gonsalves et al. | 52/259 |
| 4,443,985 | 4/1984 | Moreno | 52/259 |
| 4,604,841 | 8/1986 | Barnoff et al. | 14/73 |

*Primary Examiner*—Bruce M. Kisliuk

*Attorney, Agent, or Firm*—Thomas & Kerr

[57] ABSTRACT

A pile supported bridge assembly is disclosed in which an array of pilings is set out in a generally regular grid pattern. Temporary support channels are placed on the pilings and cap members are placed onto the supports generally perpendicular to the longitudinal axis of the bridge. Slab members are then used to span the cap members and a road surface is laid thereover, whereupon the temporary supports are removed.

20 Claims, 3 Drawing Sheets

PILE SUPPORTED BRIDGE ASSEMBLY

BACKGROUND OF THE INVENTION

Conventional bridge construction is both costly and time consuming. In general, the construction engineers must be present at the site from the start of construction until the roadbed is finished. Construction techniques and methods also vary from one site to another, thus standardized procedures and/or materials can generally not be employed. Bridges spanning wetland areas which, by federal law, can be disturbed very little, if at all, also mandate against conventional construction techniques.

In particular, wetland areas are often highly sensitive to disturbances in the environment, and as such are protected from untoward disruption by federal and state laws and regulations. Any construction must generally be approved by the Army Corps of Engineers as well as by some states. Major disruptions, such as that caused by conventional construction techniques, are normally forbidden or, if allowed, a strict and generally short time period is allowed for construction.

In other areas as well, however, conventional bridge construction can run over twenty-five hundred dollars per running foot. In addition, the projects may take many weeks or months to complete due to the customization done at each different site. Striking a balance between the above-mentioned, often competing considerations, is a difficult task. Thus a need exists in the art for a bridge construction system that causes a minimum of environmental disruption, that can be quickly and easily erected, and in which the costs are significantly reduced.

SUMMARY OF THE INVENTION

It is, therefore, one of the principal objects of the present invention to provide a pile supported, bridge assembly that utilizes standardized components and that can be quickly and easily erected with a minimum of engineering time.

Another object of the present invention is to provide a bridge assembly that can be erected for a fraction of the cost of a conventional bridge and which causes a minimum amount of disruption to the environment in which the bridge is erected.

A further object of the present invention is to provide a bridge assembly which can be easily manufactured away from or at the job site and can then be easily installed on site.

These and additional objects are attained by the present invention which relates to a pile supported bridge assembly in which piles are driven in a pre-arranged grid. The necessary height of the bridge is then determined by the engineers and temporary support means are provided on the piles at the pre-determined levels. Pile cap means are then installed over the piles to provide a support structure and pre-fabricated panels are then used to span the cap means. The roadway is then laid over the panels and the support means are removed. The present assembly can be built to any desired elevation and grade and the entire bridge can be finished in less than two days in certain cases, depending on the length of the bridge.

In general, the present assembly is manufactured from concrete with reinforcement provided as needed with rebar or wire mesh. The cap means and panels are normally pre-stressed, precast concrete to speed construction and to provide the necessary rigidity. Once the temporary support means are installed, the engineering work is essentially complete and construction laborers can complete the assembly, thus greatly reducing the cost. The use of standardized components also greatly speeds construction and contributes to a reduction in the overall costs.

Various additional objects and advantages of the present invention will become apparent from the following description, with reference to accompanying drawings.

DETAILED DESCRIPTION OF THE PREFERRED EMBODIMENT

Figure 1:
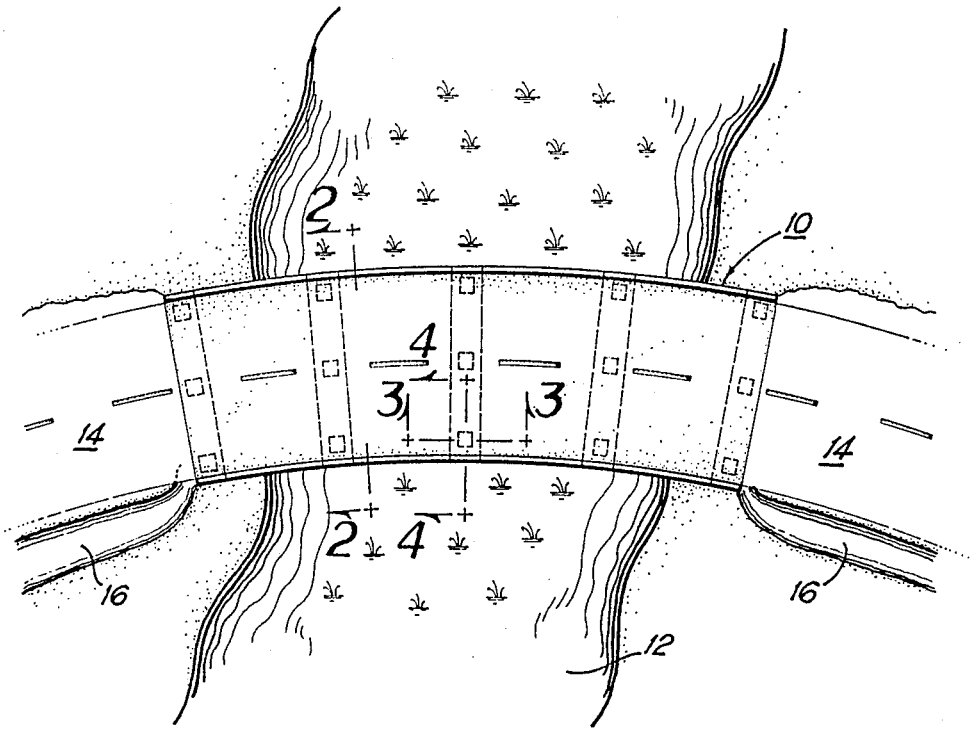
FIG. 1 is a top plan view of the present pile supported bridge assembly.

Referring now more specifically to the drawings and to FIG. 1 in particular, numeral 10 designates generally the present bridge assembly, the assembly shown in completed form spanning a wetland area 12. The bridge assembly 10 connects the opposing ends of road 14. The wetland area 12 may be marshland for example, as illustrated, such as is found along coastal areas or the bridge may be built over dry land in place of a conventional bridge. Where the bridge is constructed to span a wetland area, culverts 16 are provided to collect runoff water from the bridge for evaporation. Such a drainage system is usually necessitated by applicable laws or standards which prohibit runoff flowing directly from the bridge into the wetland area.

Figure 2:
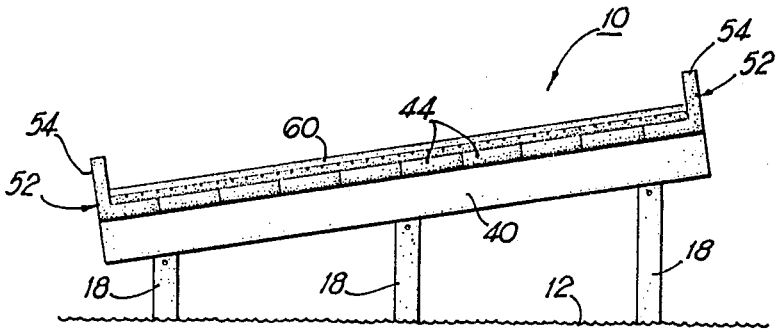
FIG. 2 is a cross sectional view of the present invention, the view being taken on line 2—2 of FIG. 1.

Detailed cross sectional and exploded views are shown in FIGS. 2 through 5. Referring to FIG. 2, it can be seen that the present bridge assembly has very few component parts and the components themselves are standardized to a great degree. The bridge assembly is supported by piles 18 which are driven down to bedrock or other suitable supporting means in a conventional manner or are similarly installed in a pre-arranged grid pattern. The number of piles and the grid pattern may vary depending on the loading requirements of the bridge. In a typical two lane road, three or four piles are set in each lateral plane relative to the longitudinal axis of the road, spaced longitudinally from three feet to twenty feet apart, and built to a desired height as determined by the engineering design.

Figure 3:
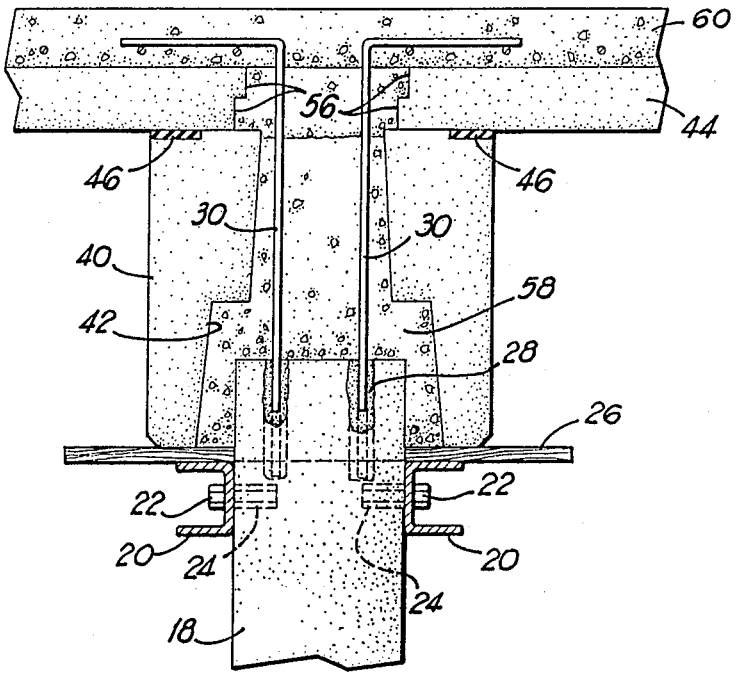
FIG. 3 is a partial cross sectional view showing the upper portion of the bridge assembly, the view being taken on line 3—3 of FIG. 1.
Figure 4:
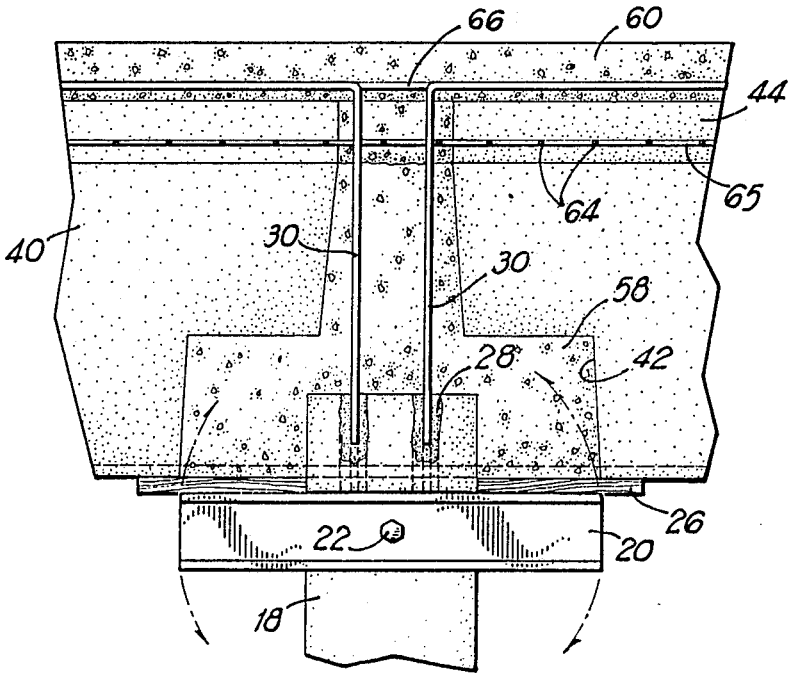
FIG. 4 is a partial, cross sectional view showing another angle of the upper portion of the present bridge assembly, the view being taken on line 4—4 of FIG. 1.

Referring to FIGS. 3 and 4, when the piles are set, temporary support means in the form of a pair of channels 20 are secured to the piles, one on each side of each pile. The channels are set so as to extend generally perpendicular to the longitudinal direction of the bridge. The positioning and height of the channels is also determined by the engineering design and the channels are anchored with a suitable securing means such as pins 22. The pins 22 are set in holes 24 which are drilled or otherwise formed in the piles and the channels are designed to pivot around the fastening pin, as indicated by the arrows in FIG. 4. The channels thus can "float" to accommodate any slope or pitch which has been designed into the bridge.

A significant advantage of the present invention is that once the point for the holes 24 is determined, the engineering work is essentially complete, and a construction crew can complete the bridge erection. This set point controls the height, elevation, slope, bank, and all other facets of the construction of the present bridge assembly. This factor, combined with the use of a plurality of standardized components, significantly reduces the cost of the bridge construction, with overall savings of as much as eighty percent being realized.

Figure 5:
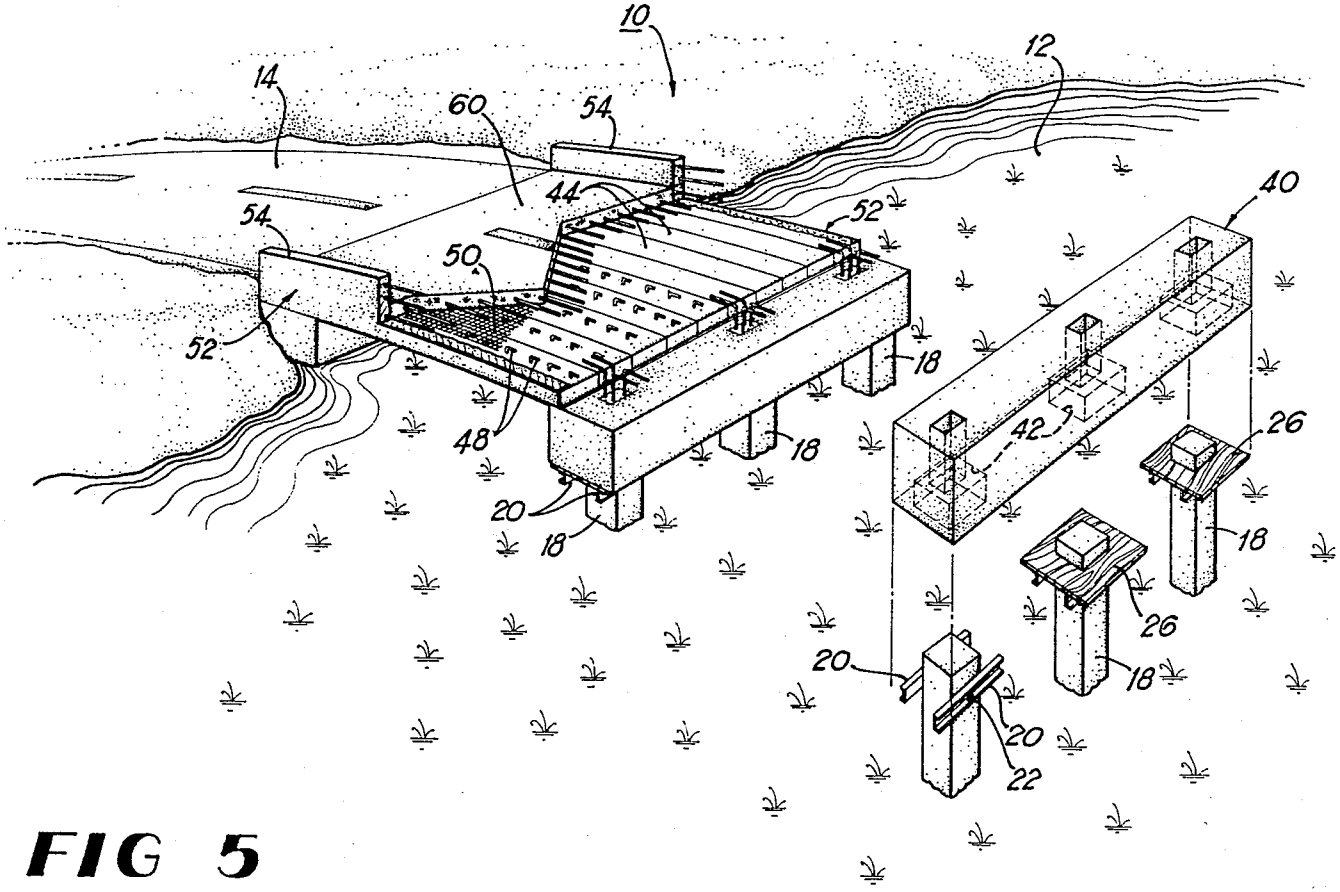
FIG. 5 is a partial, perspective view of the present bridge assembly, illustrating the sequence of construction.

With the temporary support means 20 in place, the tops of the piles are then trimmed so as to extend approximately eight inches above the top level of the support means. A platform means 26 is then placed around the piles, resting on the channels 20. The tops of the piles are then drilled, forming holes 28 and a plurality of reinforcing means such as rods 30 are placed in the drilled holes and grouted to secure them in place. A unitary cap means or bent 40 is then placed over each laterally extending row of piles, as best shown in FIG. 5. The bent rests on the platform means 26 and consequently on the channels 20, which, as noted, are designed to pivot to accommodate the designed superelevation of the bridge assembly. The bents are formed of precast, pre-stressed concrete, with further reinforcement used as needed, and include cavities 42 formed therein. The lower portions of the cavities are sized to fit over the piles while the upper portion is relatively smaller to receive the rods 30.

Slab means, such as deck beams 44, also formed from precast, pre-stressed concrete and ranging from three to twenty feet long, depending on loading requirements, are then placed, spanning from one bent to the next succeeding bent to form a base for the road surface. Disposed between the deck beams and the bent is a sealing means such as gasket 46, normally composed of rubber or other elastomeric material. The gasket seals the joint between the deck beams and the bent to prevent leakage of concrete into the wetland when the final pour is made, as described hereinbelow. The deck beams may include stirrups 48, projecting from the upper surface thereof, which, in turn, are tied to and support a reinforcing means such as mesh 50, which is laid thereover prior to the final pour and tied to the rods 30 which are bent over the tops of the beams 44. The outermost deck beam 52 is formed as an L-shaped member, thereby providing an integral side member or rail 54 for the bridge assembly.

As best shown in FIGS. 3 and 4, the bridge assembly is now ready for the final pour of concrete. The slabs or beams 44 are provided with offset faces 56, so as to provide lap joints when the concrete is poured. Concrete 58 is then poured into cavities 42 over the exposed upper surface of the bents 40 between the opposing faces of the beams 44, and over the beams between the rails 54 to form the road surface 60. This surface 60 may then serve as the road or it may be covered with asphalt if desired. Where the present bridge assembly spans a wetland area and runoff must be directed elsewhere than the wetland, drainage means (not shown) may be provided to direct any runoff to culverts 16.

Suitable reinforcement may be provided as required in the deck beams 44 by crossing rods 64 and 65 or a suitable mesh. Similarly, rods 66 may be secured to the rods 30 and the stirrups to integrate the bridge structure in combination with the final concrete pour.

When the final pour is completed and cured, the temporary support channels 20 and the platform means 26 are removed, providing a completed bridge assembly, as shown in FIG. 2. Utilizing quick-set, rapid hardening concrete, a two-lane bridge assembly can be completed in a matter of days in which conventional forms and shoving must be used for pouring and setting concrete, a bridge of similar length and width would take weeks or even months to erect.

While an embodiment of a pile supported bridge assembly and modifications thereof have been shown and described in detail herein, various additional changes and modifications may be made without departing from the scope of the present invention.

I claim:

1. A bridge assembly having a longitudinal axis comprising a plurality of generally vertical support piles disposed in a prearranged grid pattern, said piles being uniformly spaced and disposed in lateral rows and longitudinal rows relative to said longitudinal axis, a cap member disposed over each of said lateral rows of piles and generally perpendicular to said longitudinal axis and having a plurality of spaced, integral cavities formed in said cap member for receiving said piles, slab means disposed over and extending between successive cap members for providing a base for said bridge assembly, and a road surface covering said slab means.

2. A bridge assembly as defined in claim in which said assembly includes support means secured to said piles for receiving and supporting said cap members.

3. A bridge assembly as defined in claim 2 in which said support means are pivotally mounted on said piles.

4. A bridge assembly as defined in claim 1 in which said assembly includes side members having a first portion disposed parallel with said slab means and a second portion disposed generally perpendicular to said first portion for forming a side rail means for said assembly.

5. A bridge assembly as defined in claim 4 in which said assembly includes support means secured to said piles for receiving and supporting said cap members.

6. A bridge assembly as defined in claim 5 in which said support members are removably mounted on said piles.

7. A bridge assembly as defined in claim 1 in which said cavities for receiving said piles are sized to enable said piles to protrude into said cap members, and wherein concrete is poured into said cavities and over said slab means for securing said cap members on said piles and for forming said road surface.

8. A bridge assembly as defined in claim 7 in which said assembly includes support means secured to said piles for receiving and supporting said cap members.

9. A bridge assembly as defined in claim 7 in which said assembly includes side members having a first portion disposed parallel with said slab means and a second portion disposed generally perpendicular to said first portion for forming a side rail means for said assembly.

10. A bridge assembly as defined in claim 1 in which said assembly includes sealing means disposed between said cap members and said slab members.

11. A bridge assembly for connecting opposing portions of a road in a given direction and spanning a wetland area and for receiving a road surface thereover, said assembly comprising a plurality of bridge support pilings disposed in an array of longitudinally spaced sets with the pilings in each of said sets being laterally spaced, cap members disposed over each of said sets of pilings and having a plurality of laterally spaced cavities integrally formed therein to receive said pilings within said cap members, slab means disposed over said cap members for forming a base for said road surface, and a road surface applied over said slab means.

12. A bridge assembly as defined in claim 11 in which said assembly includes support means secured to said piles for receiving and supporting said cap members.

13. A bridge assembly as defined in claim 12 in which said support means are pivotally mounted on said piles.

14. A bridge assembly as defined in claim 11 in which said assembly includes side members having a first portion disposed parallel with said slab means and a second portion disposed generally perpendicular to said first portion for forming a side rail means for said assembly.

15. A bridge assembly as defined in claim 11 in which concrete is poured into said cavities of said cap members and over said slab means for securing said cap members on said piles and for forming said road surface.

16. A bridge assembly having a longitudinal axis and designed to receive a roadway thereover, said assembly comprising an array of pilings disposed in sets, the sets being generally perpendicular to said axis and spaced along said axis, cap members disposed over said sets of pilings and being generally perpendicular to said axis, said cap members each including integrally formed cavity means for receiving said longitudinally spaced sets of pilings therein, slab means disposed over said cap members and arranged generally parallel to said axis, said slab means being of a length sufficient to span two succeeding cap members, and a road surface laid over said slab means.

17. A bridge assembly as defined in claim 16 in which said assembly includes support means secured to said piles for receiving and supporting said cap members.

18. A bridge assembly as defined in claim 17 in which said support means are pivotally mounted on said piles.

19. A bridge assembly as defined in claim 16 in which said assembly includes side members having a first portion disposed parallel with said slab means and a second portion disposed generally perpendicular to said first portion for forming a side rail means for said assembly.

20. A bridge assembly as defined in claim 16 in which said cavities for receiving said piles in said cap members are sized to enable said pilings to protrude into said cap members, and wherein concrete is poured into said cavities and over said slab means for securing said cap members on said piles and for forming said road surface.

* * * * *